US005172637A

United States Patent [19]

Theurer et al.

[11] Patent Number: 5,172,637

[45] Date of Patent: Dec. 22, 1992

[54] TRACK SURFACING MACHINE FOR THE CONTROLLED LOWERING OF THE TRACK

[75] Inventors: Josef Theurer, Vienna; Bernhard Lichtberger, Leonding, both of Austria

[73] Assignee: Franz Plasser Bahnbaumaschinen-Industriegesellschaft m.b.H., Vienna, Austria

[21] Appl. No.: 806,872

[22] Filed: Dec. 12, 1991

[30] Foreign Application Priority Data

Feb. 1, 1991 [AT] Austria ..... 218/91

[51] Int. Cl.[5] ..... E01B 29/04

[52] U.S. Cl. ..... 104/7.2; 104/7.1

[58] Field of Search ..... 104/7.1, 7.2, 7.3, 8, 104/12

[56] References Cited

U.S. PATENT DOCUMENTS

| | | | |
|---|---|---|---|
| 4,166,291 | 8/1979 | Shupe | 104/7.2 |
| 4,176,456 | 12/1979 | von Beckmann | 104/8 |
| 4,528,912 | 7/1985 | Hansmann et al. | 104/7.1 |
| 4,655,142 | 4/1987 | Theurer et al. | 104/7.1 |
| 4,905,604 | 3/1990 | Theurer | 104/7.2 |
| 4,928,599 | 5/1990 | Hansmann et al. | 104/12 |
| 4,953,467 | 9/1990 | Theurer | 104/7.1 |

FOREIGN PATENT DOCUMENTS

| | | |
|---|---|---|
| 1155800 | 10/1963 | Fed. Rep. of Germany . |
| 1324073 | 7/1973 | United Kingdom . |

*Primary Examiner*—Robert J. Oberleitner
*Assistant Examiner*—Kevin D. Rutherford
*Attorney, Agent, or Firm*—Kurt Kelman

[57] ABSTRACT

A continuously advancing dynamic track stabilization machine comprises a first cross level measuring element arranged at the machine frame front end and generating reference signals corresponding to the measured cross level at successive points as the machine continuously advances, a second cross level measuring element arranged adjacent a track stabilization assembly spaced from the front end and generating a signal corresponding to the measured cross level, and a control for actuating the drives for applying a vertical load to the track rails and for vibrating the track in a horizontal, transverse direction. The control is arranged to receive the reference signals from the first cross level element, to store the received reference signals until the second cross level element has reached the successive points, to compare the stored reference signals with the signals generated by the second cross level element to obtain a control signal, and to transmit the control signal for actuating the drives.

5 Claims, 1 Drawing Sheet

TRACK SURFACING MACHINE FOR THE CONTROLLED LOWERING OF THE TRACK

BACKGROUND OF THE INVENTION

1. Field of the Invention

The present invention relates to a continuously advancing track surfacing machine for the controlled lowering of a track supported on ballast, which comprises a machine frame supported on undercarriages on the track for mobility in an operating direction and having a front end in the operating direction, a drive for propelling the machine frame continuously along the track in said direction, a power-actuated, vertically adjustable track stabilization assembly connected to the machine frame behind the front end and spaced therefrom, the track stabilization assembly including means for applying a vertical load to the track and means for vibrating the track in a substantially horizontal direction extending transversely to the track, a track leveling reference system including a measuring axle running on the track, and a control for actuating the track stabilization assembly means.

2. Description of the Prior Art

A dynamic track stabilizer of this type has been disclosed in U.S. Pat. No. 4,953,467, dated Sep. 4, 1990. It is used for the controlled lowering of the track after the ballast has been tamped during a track position correction so as to stabilize the ballast bed and to avoid the otherwise unavoidable initial settling of the track after tamping when trains run over the leveled track. This machine comprises two track stabilization assemblies centered between the front and rear undercarriages, and gripping the rail heads between eight flanged rollers engaging the gage sides and four disc rollers engaging the field sides. The vibrators of the track stabilization assemblies are synchronized to impart horizontal oscillations extending transversely to the track to the rail head gripping rollers, and four vertical drives are supported on the machine frame to apply high vertical loads to the track. Dynamic track stabilization is well known and has been used with great success in track rehabilitation but the known dynamic track stabilization machines have had the disadvantage that manual control had to be used in superelevated track sections.

U.S. Pat. No. 4,655,142, dated Apr. 7, 1987, relates to an intermittently advancing track leveling, lining and tamping machine which comprises a front and rear cross level measuring element generating control signals for the operation of the lifting drives of the track lifting assembly.

German patent No. 1,155,800, published Oct. 17, 1963, discloses an intermittently advancing track tamper whose tamping operation is controlled by a cross level measuring element arranged adjacent the tamping head.

British patent No. 1,324,073, published Jul. 18, 1973, deals with an apparatus for measuring railway track parameters including the cross level.

SUMMARY OF THE INVENTION

It is the primary object of this invention to improve a continuously advancing track surfacing machine of the indicated type wherein the controlled lowering of the track is also automatically effected in superelevated track sections.

The above and other objects are accomplished according to the invention with a continuously advancing track surfacing machine for the controlled lowering of a track supported on ballast, which comprises a machine frame supported on undercarriages on the track for mobility in an operating direction and having a front end in the operating direction, a drive for propelling the machine frame continuously along the track in said direction, a power-actuated, vertically adjustable track stabilization assembly connected to the machine frame behind the front end and spaced therefrom, the track stabilization assembly including means for applying a vertical load to the track and means for vibrating the track in a substantially horizontal direction extending transversely to the track, a track leveling reference system including a measuring axle running on the track, a first cross level measuring element arranged at the machine frame front end and generating control signals corresponding to the measured cross level at successive reference points along the track as the machine continuously advances, a second cross level measuring element arranged adjacent the track stabilization assembly and generating successive signals corresponding to cross level measured thereby, and a control arranged to receive the control signals from the first cross level element, to store the received control signals until the second cross level element has reached the successive reference points, to compare the stored control signals with the successive signals generated by the second cross level element to obtain a reference signal, and to transmit the reference signal for actuating the means for applying a vertical load and for vibrating the track.

Such a machine is able to monitor the cross level of a track whose position has been corrected by a preceding track leveling, lining and tamping machine, and to use this cross level as a reference for the immediately succeeding controlled lowering of the track by the track stabilization assembly. In other words, the desired cross level produced by the preceding leveling and tamping operation is measured by the front cross level measuring element and the corresponding control signal is stored in a memory of the control actuating the dynamic track stabilizer. The stored control signal is then transmitted to the cross level measuring element adjacent the track stabilization assembly with a delay commensurate with the speed of advancement of the machine. In this manner, the track geometry measured at the first cross level measuring element is copied at the track stabilization assembly and controls its operation so that the lowered track will have exactly the same geometry as that of the track leveled and tamped by the preceding track leveling and tamping operation.

According to a preferred feature, one measuring axle of the leveling reference system is arranged at the front machine frame end and the first cross level measuring element is mounted on this measuring axle. This enables the track cross level to be monitored accurately without requiring any additional structure and without in any way influencing the operation of the reference system.

According to another feature of the present invention, an odometer is connected to the control. In this way, the control signal corresponding to a cross level measured at point A may be stored until the track stabilization assembly for lowering the track has reached point A where the control signal is transmitted.

The continuously advancing track surfacing machine may further comprise a third cross level measuring element arranged at a rear end of the machine frame in the operating direction. This makes it possible to monitor the cross level of the lowered, dynamically stabilized track section and, furthermore, enables the machine to be advanced in either direction along the track so that the third cross level measuring element becomes the first element at the front end of the machine frame.

Finally, the means for applying a vertical load to the track may include a drive mounted at each side of the machine frame, and the control is arranged to actuate each drive independently. This enables the dynamic stabilization of switches to be improved on the basis of the following considerations:

In a switch where a branch track deviates from a main track and the rails of the branch track are fastened to long ties extending across the main and branch tracks, the track rails fastened to the long ties are subject to different lowering conditions. This leads to a difference in the extent of the lowering of the two rails if the vertical load applied by the two drives remained constant. The independent operation of the two drives makes it possible to compensate automatically for this difference and to make any manual control unnecessary.

BRIEF DESCRIPTION OF THE DRAWING

The above and other objects, advantages and features of this invention will become more apparent from the following detailed description of a now preferred embodiment thereof, taken in conjunction with the somewhat schematic accompanying drawing wherein.

DETAILED DESCRIPTION OF PREFERRED EMBODIMENT

Figure 1:
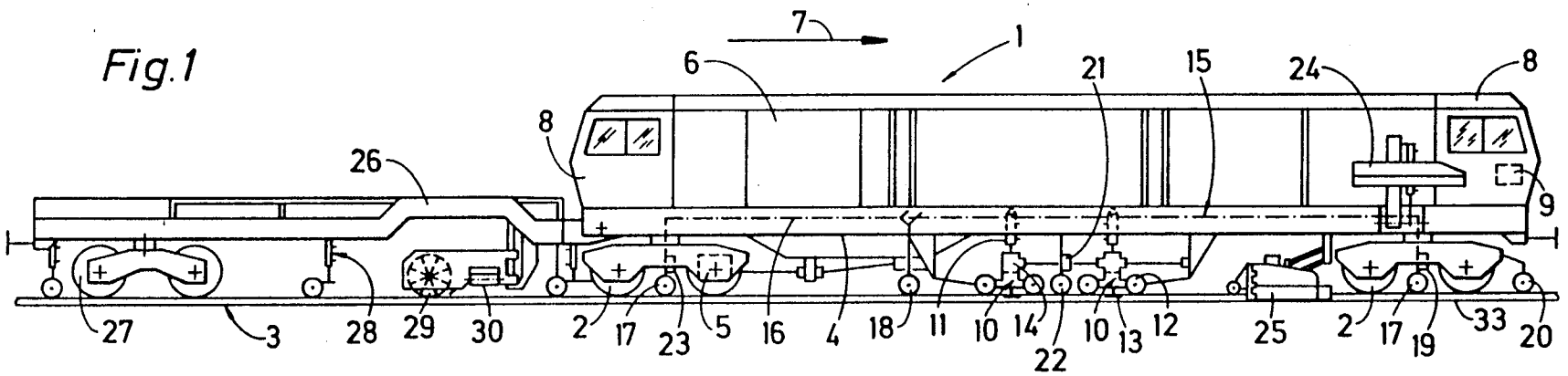
FIG. 1 is a side elevational view of a continuously advancing track surfacing machine for the controlled lowering of a track and incorporating three cross level measuring elements.

Referring now to the drawing, FIG. 1 illustrates track surfacing machine 1 of the general structure described and illustrated in detail in U.S. Pat. No. 4,953,467 and comprising elongated machine frame 4 whose front and rear ends are supported on undercarriages 2, on track 3 for mobility in an operating direction indicated by arrow 7. Central power plant 6 is mounted on the machine frame and feeds energy to drive 5 for propelling machine frame 4 continuously along track 3 in this direction. Operator's cabs 8 are arranged at the front and rear ends of the machine frame and at least one of the cabs holds control 9.

Two adjacently arranged power-actuated, vertically adjustable track stabilization assemblies 10, 10 are arranged centrally between undercarriages 2 and are linked to machine frame 4 by tie rods. Each track stabilization assembly 10 includes means 11 for applying a vertical load to track 3 and means 14 for vibrating the track in a substantially horizontal direction extending transversely to the track. In the illustrated embodiment, the means for applying a vertical load are hydraulic drives 11 mounted between machine frame 4 and track stabilization assembly 10, and the assembly comprises four flanged rollers 12 engaging the gage sides of the rail heads and two disc rollers 13 engaging the field sides of the rail heads, the rail heads being gripped between the rollers. The means for vibrating the track are synchronized vibrators 14 transmitting horizontal oscillations extending transversely to the track and having a vibratory power of up to 320 kN. The frequency of the vibrators is adjustable between 0 and 45 Hz. In the preferred embodiment, each track stabilization assembly 10 has a drive 11 which is mounted at each side of machine frame 4, and a control 9 which is arranged to actuate each drive independently. A total vertical load of about 100 kN is applied by the four drives on track 3.

The machine further comprises track leveling reference system 15 including a reference wire 16 extending above each track rail and serving as a reference for leveling the track, and a respective measuring axle 17 running on the track and supporting the front and rear ends of the reference wire. A further measuring axle 18 runs on the track adjacent the pair of track stabilization assemblies 10 and carries a track level pickup in contact with reference wire 16, and this track level pickup generates a signal controlling the lowering of track 3 by actuating drives 11 and vibrators 14 in response to the generated signal.

According to the invention, a first cross level measuring element 19 is arranged at the machine frame front end on front measuring axle 17 and generates control signals corresponding to the measured cross level at successive reference points along the track as the machine continuously advances. This cross level measuring element is an electronic precision pendulum. Furthermore, odometer 20 is connected to front undercarriage 2 and runs on the track rails. The odometer generates electrical control pulses indicating the distance traveled by machine 1 and these pulses are transmitted to control 9. Second cross level measuring element 21 is arranged adjacent track stabilization assemblies 10, 10, i.e. therebetween. The second cross level measuring element is mounted on a measuring axle 22 running on the track. Rear measuring axle 17 of leveling reference system 15 carries a third cross level measuring element 23.

Cross level measuring elements 19, 21, 23, odometer 20, vertical load applying drives 11 and vibrators 14 are all connected to central control 9 for actuating means 11 and 14 for applying a vertical load and for vibrating the track. The control is arranged to receive the control signals from cross level measuring element 19, to store the received control signals until second cross level element 21 has reached the successive reference points, to compare the stored control signals with the signals generated by cross level measuring element 21 to obtain a reference signal, and to transmit the reference signal for actuating drives 11 and vibrators 14.

A transversely and vertically adjustable shoulder plowshare 24 is mounted at each side of machine frame 4 adjacent front undercarriage 2. This is used optionally to move ballast from the shoulders to the center of the track. Ballast plow 25 is vertically adjustably mounted on the machine frame behind the front undercarriage for shaping the ballast in the center of the track, if and when needed.

Auxiliary frame 26 is pivotally coupled to the rear end of machine frame 4 and the rear end of trailer 26 is supported on track 3 by undercarriage 27. Track level monitoring system 28 is mounted on auxiliary trailer 26 for monitoring the lowering of the track by track stabilization assemblies 10. The auxiliary trailer also carries a vertically adjustable broom 29 rotatable about a transversely extending, horizontal axis for sweeping ballast off the track ties and onto a transversely extending conveyor band which conveys the swept ballast to the track shoulder.

The operation of machine 1 will now be described in more detail.

Figure 2:
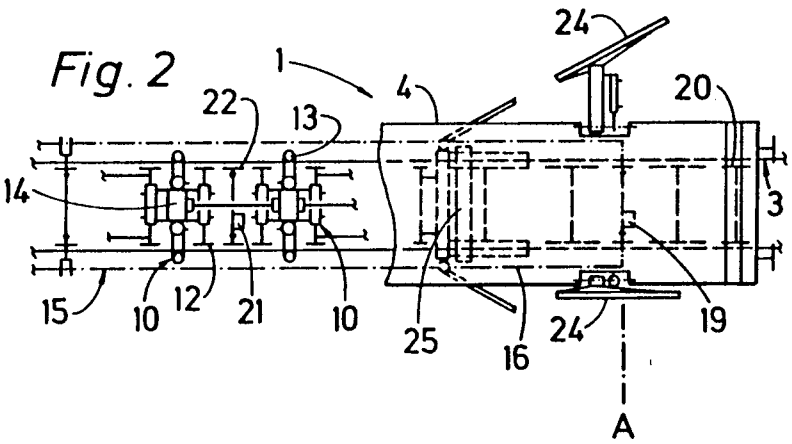
FIG. 2 is a fragmentary top view of the machine, with the machine frame broken away to show the track stabilization assemblies.

As soon as dynamic track stabilization machine 1 enters a track ramp or curve with a constantly changing superelevation, first cross level measuring element 19 mounted on front measuring axle 17 of leveling reference system 15 monitors the cross level of track 3 and generates a corresponding control signal which is transmitted to, and stored in, control 9 until odometer 20, also connected to the control, emits a number of pulses corresponding to the distance between first cross level measuring element 19 and second cross level measuring element 21. In other words, the stored cross level value measured by first cross level measuring element 19 and reflecting the desired cross level of the track is available as the desired cross level value for second cross level measuring element 21 as soon as this measuring element 21 on continuously advancing machine 1 has reached the track section A where measuring element 19 had measured the cross level (see FIG. 2).

Track stabilization assemblies 10 produce a lowering of track 3 under the control of leveling reference system 15 in a conventional manner fully described, for example, in U.S. Pat. No. 4,953,467, the extent of the settling of track 3 due to the compaction of the ballast bed by the track stabilization assemblies being controllable by changing the forward speed of machine 1 and/or the frequency of the vibrations imparted to the track and/or the vertical load P applied to the track. The leveling reference system determines the basic level of the track and is used only at one rail, i.e. the reference rail 33, while the level of the other rail 31, i.e. its superelevation with respect to the reference rail, is determined by a control signal from second cross level measuring element 21 transmitted to control 9. At track section A (FIG. 2), the cross level is measured continuously by this measuring element 21 as track stabilization assemblies 10 lower track 3 and the measured cross level values are compared in control 9 with the stored cross level value received from first cross level measuring element 19 which previously passed track section A as machine 1 continuously advances in the operating direction indicated by arrow 7. If the measured cross level value exceeds the stored cross level value, which represents the reference value, vertical load P is changed by differential value x (see FIG. 3) until the superelevation before the operation of machine 1 is identical with the superelevation after the controlled lowering of track 3 by track stabilization assemblies 10, i.e. the pressure of drives 11 against superelevated rail 31 is increased. By continuously comparing the superelevation measured at operating point A by cross level measuring element 21 with the reference cross level value measured by preceding cross level measuring element 19, the reference cross level is "copied" for a correspondingly controlled lowering of the track at point A. Therefore, the track geometry remains unchanged after the dynamic track stabilization and the reference cross level is retained.

Figure 3:
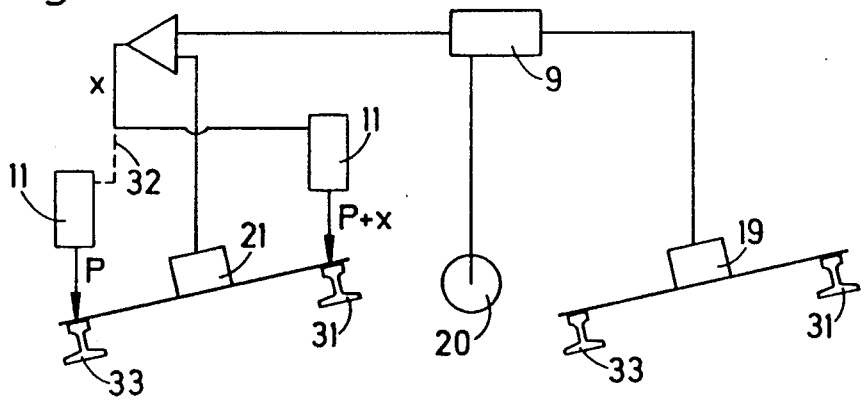
FIG. 3 is a simplified diagram of the control circuit connecting the first and second cross level measuring elements to the control.

As indicated by broken line 32 in FIG. 3, vertical load applying drives 11 acting on reference rail 33 may also receive differential value x when the machine passes over a right curve and rail 33 is superelevated.

Third cross level measuring element 23 at the rear of machine 1 enables the cross level of track 3 to be measured after the dynamic stabilization of the track and this measurement may be used for establishing a graphic record of the track level. If auxiliary trailer 26 is uncoupled, the operating direction of machine 1 may be reversed, with the third cross level measuring element 23 becoming the first measuring element 19. Particularly in switch sections, it is possible to compensate for the different conditions to which the rails at opposite ends of long ties are subjected by track stabilization assemblies 10 during lowering by independently controlling the pressure in drives 11 at the opposite rails.

What is claimed is:

1. A continuously advancing track surfacing machine for the controlled lowering of a track supported on ballast, which comprises (a) a machine frame supported on undercarriages on the track for mobility in an operating direction and having a front end in the operating direction, (b) a drive for propelling the machine frame continuously along the track in said direction, (c) a power-actuated, vertically adjustable track stabilization assembly connected to the machine frame behind the front end and spaced therefrom, the track stabilization assembly including means for applying a vertical load to the track and means for vibrating the track in a substantially horizontal direction extending transversely to the track, (d) a track leveling reference system including a measuring axle running on the track, (e) a first cross level measuring element arranged at the machine frame front end and generating control signals corresponding to the measured cross level at successive reference points along the track as the machine continuously advances, (f) a second cross level measuring element arranged adjacent the track stabilization assembly and generating successive signals corresponding to the cross level measured thereby, and (g) a control arranged to receive the control signals from the first cross level element, to store the received control signals until the second cross level element has reached the successive reference points, to compare the stored control signals with the successive signals generated by the second cross level element to obtain a reference signal, and to transmit the reference signal for actuating the means for applying a vertical load and for vibrating the track.

2. The continuously advancing track surfacing machine of claim 1, wherein the measuring axle is arranged at the front machine frame end and the first cross level measuring element is mounted on the measuring axle.

3. The continuously advancing track surfacing machine of claim 1, further comprising an odometer connected to the control.

4. The continuously advancing track surfacing machine of claim 1, further comprising a third cross level measuring element arranged at a rear end of the machine frame in the operating direction.

5. The continuously advancing track surfacing machine of claim 1, wherein the means for applying a vertical load to the track includes a drive mounted at each side of the machine frame, and the control is arranged to actuate each drive independently.

* * * * *